United States Patent [19]

Alt et al.

[11] Patent Number: 4,534,654

[45] Date of Patent: Aug. 13, 1985

[54] HIGH-SPEED FLUID BLENDER

[75] Inventors: Daniel M. Alt, Baltimore; Michael J. Sackett, Glen Arm, both of Md.

[73] Assignee: A. J. Sackett & Sons Co., Baltimore, Md.

[21] Appl. No.: 517,587

[22] Filed: Jul. 27, 1983

[51] Int. Cl.[3] ..... B01F 5/10

[52] U.S. Cl. ..... 366/137; 366/168; 366/190; 366/191; 366/264; 366/302; 366/315; 366/316

[58] Field of Search ..... 366/134, 136, 137, 168, 366/173, 181, 190, 191, 262, 263, 264, 265, 279, 302, 315, 316; 415/90, 206, 207, 219 B

[56] References Cited

U.S. PATENT DOCUMENTS

| | | | |
|---|---|---|---|
| 483,542 | 10/1892 | Creaser | 366/316 |
| 555,061 | 2/1896 | Wheelwright | 366/137 |
| 1,061,142 | 5/1913 | Tesla | 415/90 |
| 1,909,487 | 5/1933 | Cowles | 366/137 |
| 2,277,120 | 3/1942 | Lindsey | 366/137 |
| 2,626,135 | 1/1953 | Serner | 366/316 |
| 3,316,843 | 5/1967 | Vaughan | 366/264 |
| 3,342,605 | 9/1967 | McCrossen | 366/264 |
| 3,486,741 | 12/1969 | Midgette | 366/316 |
| 3,565,404 | 2/1971 | Reid | 366/137 |
| 3,893,659 | 7/1975 | Kirsh | 366/137 |
| 4,000,001 | 12/1976 | Toth | 366/136 |
| 4,255,081 | 3/1981 | Oklejas | 415/90 |
| 4,335,994 | 6/1982 | Gurth | 415/90 |
| 4,347,033 | 8/1982 | Possell | 415/90 |

FOREIGN PATENT DOCUMENTS

| | | | |
|---|---|---|---|
| 405809 | 9/1943 | Italy | 415/90 |

OTHER PUBLICATIONS

"Disk Pumps/We Move Abrasive and High Viscosity Materials", Eureka Pumps International, Inc., 1980.

*Primary Examiner*—Robert W. Jenkins
*Assistant Examiner*—Arthur D. Dahlberg
*Attorney, Agent, or Firm*—Leonard Bloom

[57] ABSTRACT

A high-speed fluid blender for liquid fertilizer employs a slurry-type pump for both mixing and recirculation. The pump has a plurality of parallel spaced-apart blades, each of which comprises a disc having a central circular opening formed therein. One of the discs, such as the top disc, is driven by a shaft powered by a motor. The remaining discs are carried by the driven disc for rotation in unison. The discs are substantially alined coaxially of one another, and the disc assembly is housed within an annular pump housing. The circumferential edges of the discs have a substantial radial clearance with respect to the annular wall of the pump housing. This radial clearance increases in the direction of rotation of the blade assembly towards the discharge opening in the pump housing. A funnel-shaped hollow neck housing is secured to the bottom wall of the pump housing, in communication with the inlet opening therein, and diverges outwardly therefrom. The overall apparatus has substantially less cost and less power requirements, yet has substantially more pumping capacity, than commercially available equipment for the same purpose.

19 Claims, 10 Drawing Figures

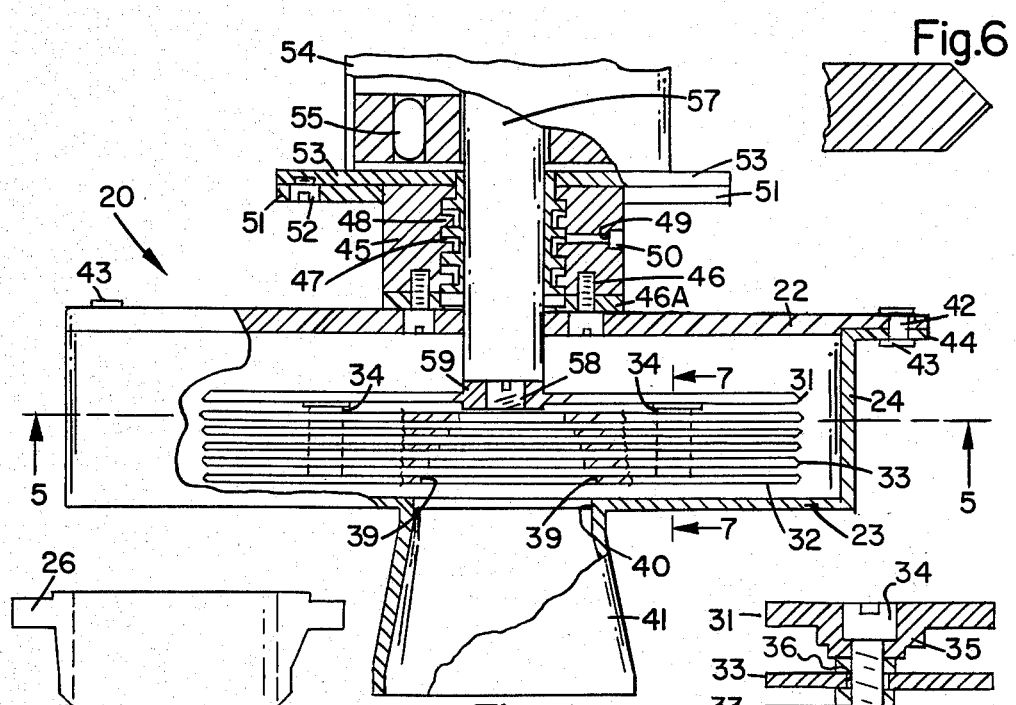
Fig.6
Fig.4
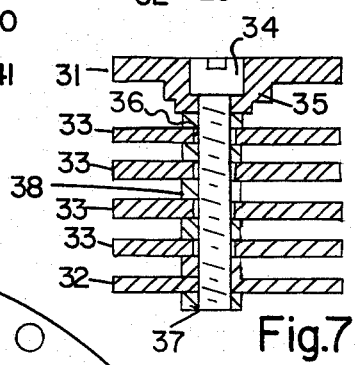
Fig.7
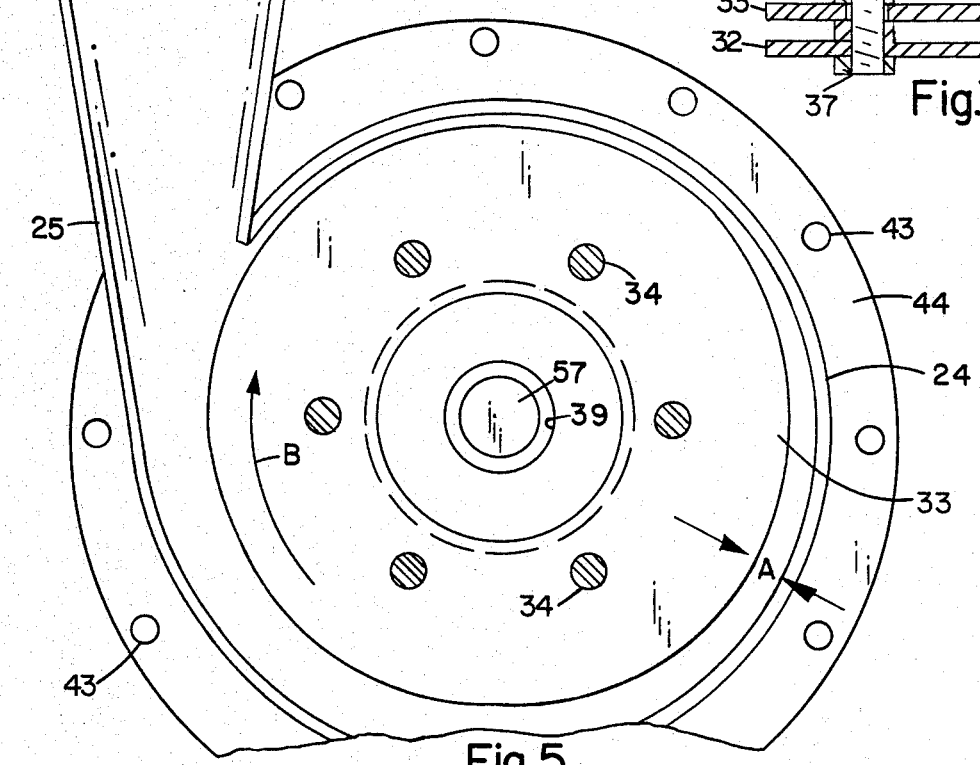
Fig.5

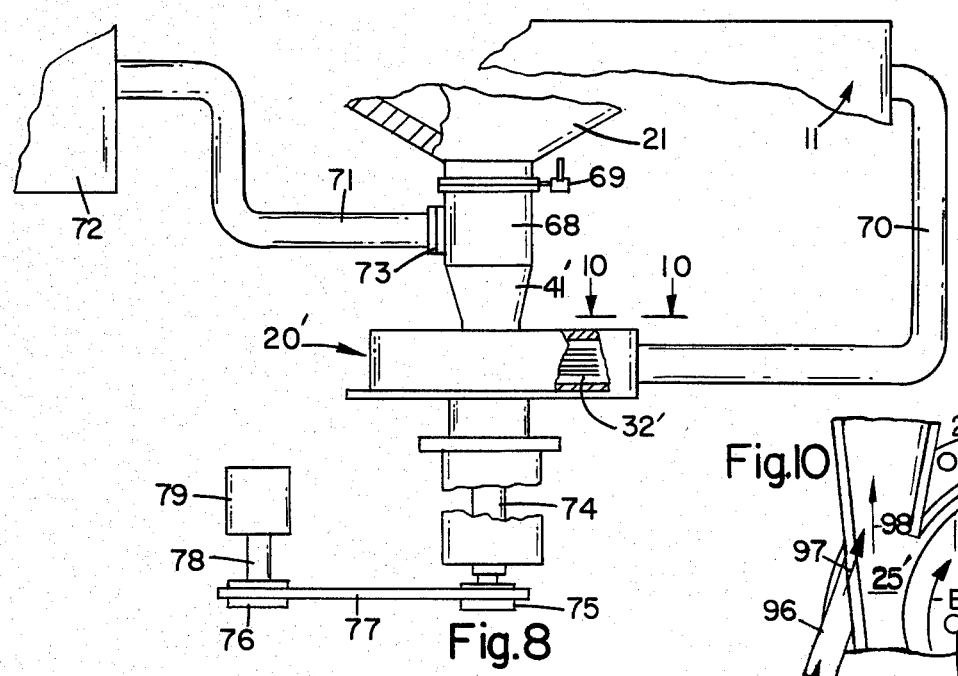
Fig.8
Fig.10
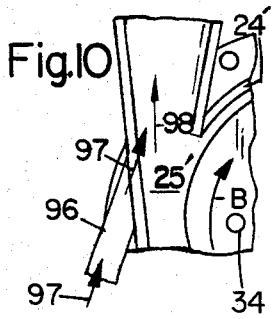
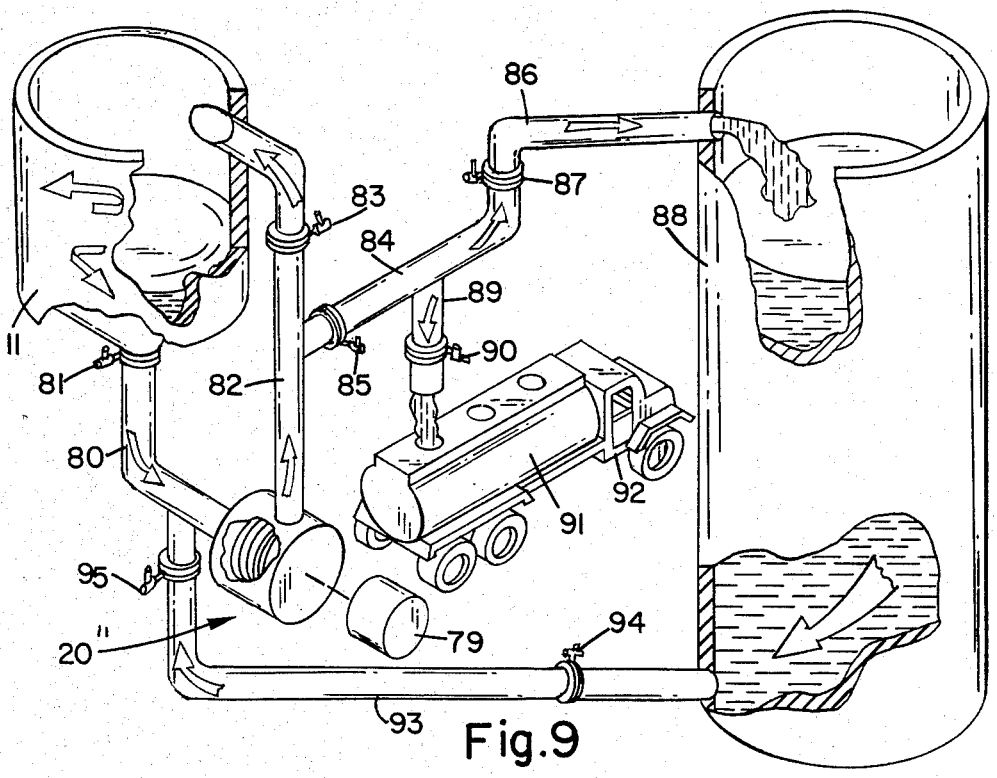
Fig.9

HIGH-SPEED FLUID BLENDER

FIELD OF THE INVENTION

The present invention relates to a fluid blender for industrial purposes, and more particularly, to a high-speed fluid blender especially adapted for the fertilizer industry.

BACKGROUND OF THE INVENTION

Liquid blenders for the fertilizer industry are well known in the prior art. These commercial blenders consist of a large vertically-oriented tank mounted on scales for carefully measuring the desired ingredients placed into the tank in a given sequence. A vertical shaft is journaled in suitable bearings, substantially coaxially of the tank, and is driven by an electric motor and suitable belts mounted above the tank. An impeller is mounted on the bottom end of the drive shaft for providing the desired mixing action within the funnel-shaped bottom portion of the tank. The impeller may consist of a stirrer (resembling a "propeller") or a fan wheel or a circular plate having vanes and apertures. An external pump, together with respective conduits, flexible couplings and valves, are necessary to draw off the mixture and recirculate it back into the tank. Whenever appropriate, the pump also draws off the mixture and pumps it into storage tanks or truck-driven trailer tanks.

A mixing apparatus having this general configuration is shown, for example, in U.S. Pat. No. 2,706,622 issued in 1955, wherein the impeller consists of a rotating pump wheel having a plurality of circumferentially-spaced radially-directed vanes.

The prior art also includes U.S. Pat. No. 3,263,968 for a "slurry handling apparatus" issued in 1966. In this patent, a buried tank receives manure via a trough in the barn, and a centrifugal pump provides for internal circulation and external discharge. The pump has a rotary impeller with radially-extending vanes. A vertically-mounted electric motor provides power to the pump via a V-belt drive.

On the other hand, conventional slurry pumps (per se) are well-known in the prior art. These pumps are intended for pumping a variety of liquids and materials, such as sludge, and generally consist of a plurality of parallel spaced-apart discs suitably mounted together and driven in unison. Examples are shown in U.S. Pat. No. 1,061,142 issued in 1913 and U.S. Pat. No. 2,087,834 issued in 1937, the latter constituting a "fluid impeller and turbine" and having a series of annular plates provided with internal openings of progressively increasing diameter.

Despite these isolated disclosures in the prior art, no one to date has conceived of the unique combination of a specially-designed fluid pump (similar to a conventional slurry pump) in a high-speed fluid blender especially adapted for the liquid fertilizer industry.

SUMMARY OF THE INVENTION

Applicant has discovered that remarkable advantages are obtained by means of a specially-designed pump assembly (similar to that of a conventional slurry pump) in a high-speed fluid blender for the fertilizer industry. Compared to existing industrial equipment presently available on the market, the pumping capacity is substantially improved; the operating power requirements are substantially reduced; the necessity of an external pump may be obviated; and the total cost of the equipment is likewise substantially reduced. In one commercial embodiment, the cost was reduced by approximately one-third over competitive equipment. These are significant advantages heretofore not available in this industry.

Accordingly, it is an object of the present invention to provide a unique combination of a slurry type of pump assembly in a conventional high-speed fluid blender for the fertilizer industry.

It is another object of the present invention to provide a pump assembly comprising a plurality of blades formed by parallel spaced-apart discs within an annular pump housing, wherein each of the driven discs has a central circular opening formed therein for communication with the inlet opening in the pump.

It is yet another object of the present invention to provide a substantial radial clearance between the rotating discs and the annular wall of the pump housing, thereby preventing clogging of the fertilizer particles within the pump housing.

It is a further object of the present invention to provide an increasing radial clearance in the direction of blade rotation, thereby substantially increasing the velocity of fluid flow towards the tangential discharge of the pump assembly.

It is a still further object of the present invention to substantially reduce the aggravating "bumping" action incurred when injecting anhydrous ammonia under pressure into the liquid fertilizer tanks of the prior art.

In accordance with the teachings of the present invention, there is disclosed herein a preferred embodiment, wherein a generally-cylindrical pump housing is disposed within the mixing tank of the fluid blender. This pump housing has respective side walls joined by an annular wall. One of the side walls has an inlet opening formed therein substantially coaxially of the housing, and the annular wall of the housing has a discharge opening formed therein. An assembly of a plurality of spaced-apart parallel planar discs is rotatably mounted within the housing, and the discs have a substantial radial clearance with respect to the annular wall of the housing. Most of the discs have a central opening formed therein in communication with the inlet opening in the side wall; and means are provided, extending through the other side wall of the housing, for driving the disc assembly.

In accordance with the further teachings of the present invention, a funnel-shaped hollow neck member is secured to the one side wall of the housing, is alined with the inlet opening therein, and diverges outwardly therefrom towards the bottom of the tank. Each of the central openings in the respective discs are circular and increase in diameter in a direction towards the hollow neck member. The radial clearances between the annular pump housing and the circumferences of the respective discs increases in the direction of rotation towards the tangential discharge opening in the annular wall of the pump housing, thereby creating a volute chamber for increased velocity of the fluid flow. The vertically-oriented drive shaft is secured to the first or top disc, and the other discs are carried by the first disc for rotation in unison. The first disc is thicker than the other discs, and the discs are spaced uniformly with respect to each other. The circumferences of the respective discs have beveled edges.

In an alternate embodiment, the pump housing and the hollow neck housing are mounted externally of the tank, and a conduit connects the bottom of the tank to the neck housing. The means to drive the disc assembly includes an electric motor, drive pulleys and a belt disposed substantially below (rather than above) the tank. This arrangement results in a further cost savings and facilitates convenient maintenance and operating control. In a further modification, pressurized anhydrous ammonia is injected into (and merges with) the tangential discharge of the pump, thereby forming a foam which acts as a shock absorber to substantially reduce the troublesome "bumping" action experienced in the prior art.

These and other objects of the present invention will become readily apparent from a reading of the following specification, taken in conjunction with the enclosed drawings.

BRIEF DESCRIPTION OF THE DRAWINGS

FIG. 4 is an enlarged portion of FIG. 3, with parts broken away and sectioned, showing the detailed construction of the improved pump assembly.

FIG. 5 is a section view, taken along the lines 5—5 of FIG. 4, showing the substantial radial clearance between the discs and the annular wall of the pump housing, and further showing the volute chamber between the blades and the annular wall.

FIG. 6 is an enlarged view of the tip of one of the discs.

FIG. 7 is a section view, taken along the lines 7—7 of FIG. 4 drawn to an enlarged scale, and showing one of the bolts and spacers for assembling the discs together.

FIG. 8 is an alternate embodiment (somewhat schematic) showing the improved pump assembly mounted externally of the mixing tank.

FIG. 9 (somewhat schematic) illustrates the manner in which the present invention may be used selectively for mixing, shipment for storage, or recirculating the storage.

FIG. 10 is a partial plan view of a portion of FIG. 8, taken along the lines 10—10 of FIG. 8, and showing a means for injecting anhydrous ammonia into the tangential discharge of the external pump.

GENERAL DESCRIPTION OF THE PREFERRED EMBODIMENT

Figure 1:
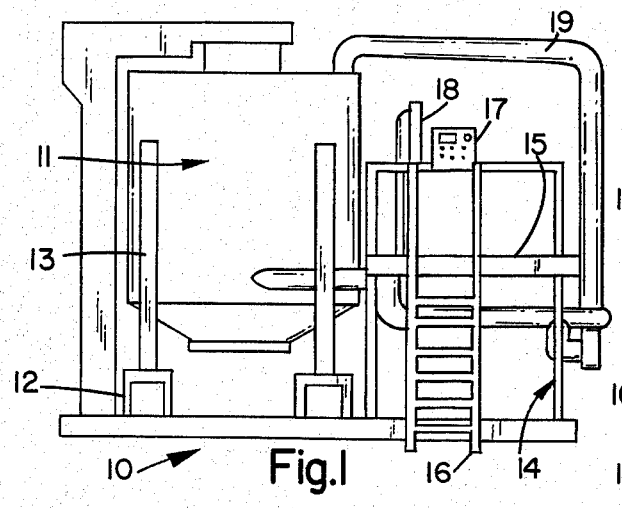
FIG. 1 is a front elevation of the improved high-speed fluid blender (mounted within a supporting frame) and incorporating the improvements of the present invention.
Figure 2:
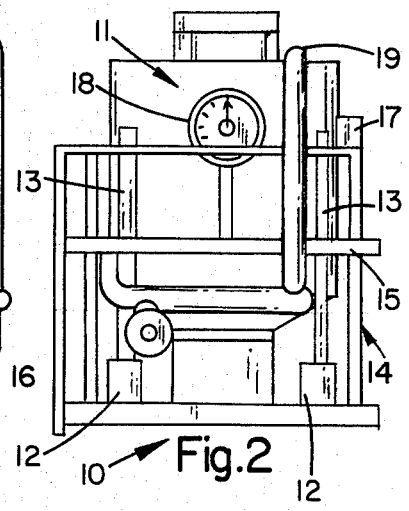
FIG. 2 is a side elevation thereof.

With reference to FIGS. 1 and 2, the high-speed fluid blender 10 of the present invention generally comprises a vertically-oriented cylindrical mixing tank 11 mounted on scales 12. The tank is supported for limited "floating" movement within a plurality of circumferentially-spaced supporting members 13 mounted on a frame 14. The frame includes a platform 15 accessible by a ladder 16. Operating controls 17 and a gauge 18 for the scales are mounted on the platform. Various pipes or conduits (generally denoted at 19) provide for recirculation of the liquid fertilizer within the mixing tank and for drawing off its contents, as desired.

The mixing tank 11 is open at the top, and the fertilizer ingredients are either pumped into the tank, or else received into the tank via its open top. The desired sequence in which the ingredients are placed in the tank is carefully controlled. In one commercial embodiment, these ingredients consist of water, mono-ammonium-phosphate (referred to as "MAP"), anhydrous ammonia, and a jelling clay. The jelling clay is preferably drawn into the tank by a reverse suction effect via a bypass conduit equipped with a funnel, which (being conventional) has been omitted for ease of illustration. The purpose of the jelling clay is to assure that the solid particles will be kept in suspension. The overall mixture is substantially homogenous and may be subsequently used as fertilizer and applied on farms by sprayers or other suitable equipment.

Figure 3:
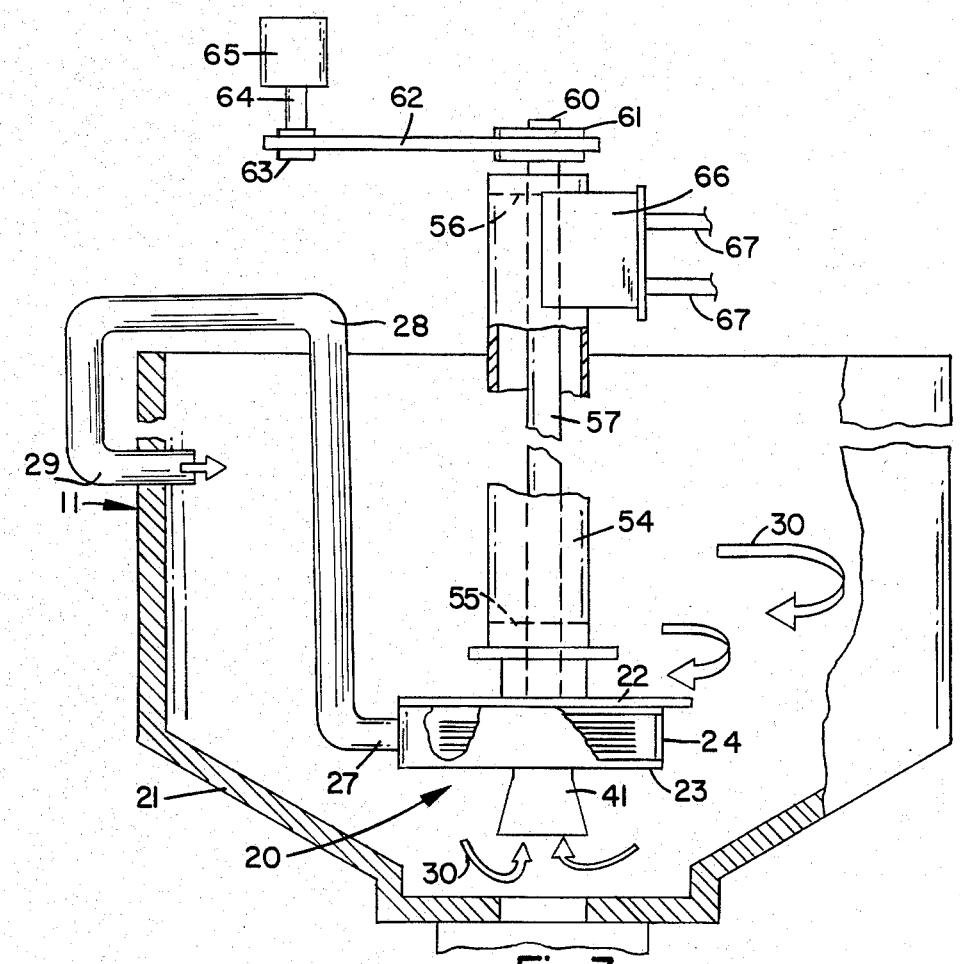
FIG. 3 is an enlarged portion of the mixing tank shown in FIG. 1, the view being somewhat schematic and taken from the other side of the mixing tank of FIG. 1, and the tank being cut-away and sectioned to show the improved pump assembly partially in section and partially in elevation.

With reference to FIGS. 3–7, the improved fluid blender of the present invention has a pump assembly 20 disposed within the truncated funnel-shaped bottom 21 of the mixing tank. This pump assembly 20 has a generally-cylindrical pump housing including a pair of side plates 22 and 23 joined by an annular wall 24. In the embodiment of FIG. 3, side plate 22 constitutes a top plate and side plate 23 consitutes a bottom plate. This annular wall has a tangential discharge conduit 25 (shown more clearly in FIG. 5) which is connected by a flange 26 and elbow 27 to a recirculating pipe 28. Preferably, this recirculating pipe (as shown more clearly in FIG. 3) extends horizontally above the top of the mixing tank and re-enters into the tank (at the other side thereof) via conduit 29. The recirculation of the mixture within the tank is indicated by the arrows 30.

The pump assembly 20 further has a plurality of parallel spaced-apart substantially-planar round discs, comprising the circular rotor blades of the pump. In this preferred embodiment, a driven top rotor blade 31 carries a bottom blade 32 and four intermediate blades 33 for rotation in unison. As shown more clearly in FIG. 7, elongated bolts 34 are received in depending sockets 35 welded to the bottom of the top blade. These bolts pass through holes 36 in the intermediate blades and are received in respective nuts 37 welded to the bottom blade. Six bolts are preferably employed, spaced sixty degrees from one another as shown in FIG. 5, and spacers 38 are mounted between the blades. The top blade is thicker than the remaining blades, and the blades are preferably spaced uniformly with respect to each other. In the preferred embodiment, the top blade is $\frac{3}{8}$ inch thick, the remaining blades are $\frac{1}{4}$ inch thick, and the blades are spaced $\frac{3}{8}$ inch apart. However, any combination of blade thicknesses and spacing are equally feasible and consonant with the teachings of the present invention. The blades may be formed from cold-rolled carbon steel (or other suitable material). If desired, the circumferential edge or tip of each blade may be machined to form a beveled or tapered edge 34, as shown more clearly in FIG. 6.

The blades 31–33 are preferably of the same diameter, are substantially alined coaxially with one another, and have a substantial radial clearance (denoted by A in FIG. 5) with respect to the annular wall of the pump housing. This assures that the granular ingredients placed into the tank (such as the "MAP" or jelling clay previously described) will not clog the pump assembly and will be properly mixed with the water and anhydrous ammonia. The bottom blade 32 and the four intermediate blades 33 (which are driven in the top blade 31) are each formed with a central circular opening 39. In the overall assembly, these circular openings are coaxially alined with one another and increase in diameter towards the bottom blade as shown more clearly in FIG. 4. In the preferred embodiment, the blades are twenty inches in diameter, and the circular opening in the bottom blade is approximately six inches.

As shown more clearly in FIG. 5, the radial clearance A between the annular wall of the pump housing and the circumferences of the respective blades continually increases in the direction of rotation of the blade assembly (towards the tangential discharge) as indicated by the letter B. This forms a volute chamber between the rotating blades and the pump housing, thereby substantially increasing the velocity of fluid flow towards the tangential discharge.

The side plate 23, constituting the bottom plate of the pump housing in the preferred orientation of FIGS. 3 and 4, has an inlet opening 40 formed therein. A generally funnel-shaped hollow inlet neck 41 is carried by the bottom plate and is in communication with the inlet opening therein. This inlet neck 41 is tapered, as shown, and diverges in a direction away from the pump housing. The inlet opening in the bottom plate and the circular openings in the disc-like blades form a substantial continuation of the fluid path initiated within the hollow inlet neck. This neck is spaced from the bottom of the mixing tank, as shown in FIG. 3.

The side plate 22, constituting the top plate of the pump assembly in the orientation shown, comprises a housing plate secured by bolts 42 and nuts 43 to a radially-projecting annular flange 44 carried by the annular wall of the pump housing. A generally-cylindrical seal housing 45 is secured to the housing plate by bolts 46, as shown more clearly in FIG. 4, with a spacer 46A therebetween. The seal housing has a central cylindrical cavity 47 provided with a plurality of parallel internal annular projections 48. A radial inlet 49 provided with a grease fitting 50 allows grease or a suitable lubricant to be introduced under pressure within the cavity of the seal housing. The seal housing further has an annular flange 51 secured by bolts 52 to the annular flange 53 of a vertical tube 54, the latter comprising a pump support housing disposed substantially coaxially of the mixing tank.

Tube 54 carries roller bearings 55 and 56 for rotatably journaling a drive shaft 57 as shown more clearly in FIG. 3. The lower end of the drive shaft is threaded, as at 58, to engage a threaded collar 59 welded to the top blade 31 as shown more clearly in FIG. 4. The top 60 end of the drive shaft carries a pulley (or sheave) 61 provided with a vee-belt 62. The belt engages a pulley 63 mounted on a shaft 64 driven by an electric motor 65. The motor and belt drive are exemplary only, and it will be appreciated that other drive systems are also feasible. The top of the tube carries a support bracket 66 which is secured to the overall frame of the apparatus by beams 67 or other suitable members.

As compared with the existing equipment presently available on the market, the apparatus of the present invention has the following advantages:

(1) Less operating power requirements—roughly one-third to one-half, depending upon whether an external "fluidizer" is used in competitive equipment;

(2) More pumping capacity—roughly 1600 gallons per minute compared to 1200;

(3) Less cost—roughly one-third less than competitive apparatus; and (4) A combination mixing and recirculation function, which readily facilitates mixing, recirculation from storage, and shipment as desired.

As previously noted, these are commercially significant advantages heretofore not available in the prior art.

An alternate embodiment of the present invention is illustrated in FIG. 8, wherein the pump assembly 20' is reversed and is mounted externally of the tank (rather than internally as shown in FIG. 3). The inlet neck 41' of the pump assembly is connected to the funnel-shaped bottom of the tank 11 by means of a conduit 68 provided with a suitable valve 69. The recirculating pipe is external of the tank and includes a conduit 70 connected to the discharge of the pump. A discharge pipe 71 is connected between the conduit 68 and a storage tank 72, and is controlled by a suitable valve 73. The valves, being conventional, are illustrated schematically. Since the pump assembly has been reversed, the bottom blade (disc) 32' is driven by a shaft 74 carrying a pulley 75. Pulley 75 is driven by a pulley 76 via a belt 77, and power to the pulley 76 is provided by a shaft 78 and electric motor 79. With this arrangement, the motor and drive components are located below (and to the side of) the mixing tank; and as a result, construction and maintenance costs are further reduced, while operating controls are facilitated.

A schematic presentation of the overall apparatus showing the applicability of the alternate embodiment (but equally applicable to the preferred embodiment) is shown in FIG. 9. The pump assembly 20'' has been oriented vertically, in lieu of horizontally in FIG. 8, and is connected to the mixing tank 11 by conduit 80 controlled by valve 81. The discharge from the pump assembly is connected to a recirculating pipe 82 which is controlled by a valve 83. An alternate pipe 84 controlled by a valve 85 is connected to pipe 82. Pipe 84 has a first branch 86 (controlled by a valve 87) leading to a storage tank 88, and further has a second branch 89 (controlled by a valve 90) for connection to a tank 91 driven by a truck 92. A pipe 93 from the bottom of the storage tank is connected to conduit 80 and is controlled by valves 94 and 95. With this arrangement, the present invention may be used for mixing, shipment from storage, or recirculation of storage as desired. The pump thereby serves a dual function, and the use of a secondary pump (required in commercial prior art systems) may be obviated.

A modification of the apparatus shown in FIG. 8 is shown in FIG. 10. There, anhydrous ammonia (or an equivalent reactive liquid fertilizer ingredient) is injected via pipe 96 substantially tangentially of the pump housing 24' (as indicated schematically by the arrows 97) to merge with the tangential discharge thereof (the latter indicated schematically by the arrow 98) flowing through the opening 25'.

The anhydrous ammonia reacts with the monoammonium phosphate (the "MAP") or other phosphate fertilizers in a known chemical process; otherwise, the anhydrous ammonia will evaporate as a gas. When the pressurized anhydrous ammonia is injected into the mixing process in the commercial prior art practices, it expands upon contact with the liquids, thereby creating an audible "thumping" or "bumping" action which tends to rattle the overall apparatus and slows the mixing process. This bumping action is annoying and limits the rate at which the anhydrous ammonia is injected into the mixing tank. However, with the benefit of the present invention, as depicted schematically by the arrows 97 and 98 in FIG. 10, a turbulence is created at the discharge opening which forms a foam. This foam acts as a "shock absorber" and substantially reduces (if not eliminates ) the troublesome bumping action heretofore encountered in the prior art. This is yet another advantage and unexpected result obtained by the present invention.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In a high-speed fluid blender having a mixing tank, wherein the tank is provided with a top portion and is further provided with a truncated frusto-conical bottom portion, and wherein the blender is intended for mixing chemical fertilizers which may include one or more granular ingredients in suspension in water, the improvement which comprises a combined means for mixing and recirculating the contents of the tank, including a pump assembly provided with a generally-cylindrical pump housing having respective side walls joined by an annular wall, one of the side walls having a central inlet opening formed therein substantially coaxially of the housing, first conduit means directing the liquid into the inlet opening of the pump from the frusto-conical bottom portion of the tank, the annular wall of the housing having a tangential discharge opening formed therein, second conduit means connecting the discharge opening with the top portion of the tank, an assembly of a plurality of spaced-apart parallel blades rotatably mounted within the housing and having a substantial radial clearance with respect to the annular wall of the housing, wherein the granular ingredients will not clog the pump assembly and will be mixed properly with the water, at least some of the blades having a central opening formed therein substantially coaxial with and in communication with the inlet opening in the one side wall, means extending through the other side wall of the housing for driving the blade assembly; wherein the pump assembly serves the dual fiunction of mixing and recirculating, whereby the necessity for a separate recirculating pump may be obviated, and means for injecting a liquid fertilizer under pressure to merge with the tangential discharge of the pump, thereby creating a turbulence to substantially relieve the "bumping" action caused by expansion of the pressurized liquid fertilizer upon contact with the liquid in the tank.

2. The improvement of claim 1, wherein the blades comprise planar discs including top and bottom discs, and wherein the top and bottom discs have a substantial axial clearance with respect to the respective side walls of the pump housing.

3. The improvement of claim 2, wherein the first conduit means includes a funnel-shaped hollow neck member secured to the one side wall of the housing, alined with the inlet opening therein, and diverging outwardly therefrom.

4. The improvement of claim 3, wherein the central openings in the respective discs are circular and increase in diameter in a direction towards the hollow neck member, thereby forming a substantial continuation of the fluid path within the member.

5. The improvement of claim 2, wherein the pump housing is mounted within the tank, and wherein the means for driving the disc asembly includes a drive shaft rotatably journaled within a vertical tube extending substantially coaxially of the tank.

6. The improvement of claim 5, wherein the drive shaft is secured to a first disc, and wherein the other discs are carried by the first disc for rotation in unison.

7. The improvement of claim 6, wherein the first disc is thicker than the remaining discs, each of which has substantially the same thickness, and wherein the discs are uniformly spaced with respect to each other.

8. The improvement of claim 6, wherein the discs have tapered circumferential edges.

9. The improvement of claim 1, wherein the pump housing is mounted externally of the tank, wherein the first conduit means comprises a conduit which connects the bottom of the tank to the pump housing, and wherein the means to drive the blade assembly comprises a motor, drive pulleys and a belt disposed substantially below the tank.

10. The improvement of claim 1, wherein the radial clearance between the blades and the annular wall increases in the direction of rotation towards the tangential discharge opening, thereby increasing the velocity of fluid flow.

11. A high-speed fluid blender especially adapted for mixing chemical fertilizers which may include one or more granular ingredients in suspension in water, the blender comprising, in combination, a mixing tank having a bottom wall, a pump assembly including a generally-cylindrical pump housing near the bottom wall of the tank and generally coaxial therewith, the pump housing having respective top and bottom walls joined by an annular wall, one of the top and bottom walls having an inlet opening formed therein substantially coaxially of the pump housing, the annular wall of the housing having a tangential discharge opening formed therein, a funnel-shaped hollow neck member secured to one of the top and bottom walls of the pump housing and alined with the inlet opening therein, the hollow neck member diverging outwardly therefrom and being spaced from the bottom wall of the mixing tank, an assembly of a plurality of spaced-apart parallel planar discs rotatably mounted within the pump housing and having a substantial radial clearance with respect to the annular wall of the pump housing, wherein the granular ingredients will not clog the pump assembly and will be mixed properly with the water, the disc assembly including a first disc, a second disc and a plurality of intermediate discs, means for securing the second and intermediate discs to the first disc for rotation in unison, the second and intermediate discs each having a central opening formed therein in communication with the inlet opening in the pump housing, each of the openings in the disc being circular and increasing in diameter in a direction towards the inlet opening in the pump housing and forming a substantial continuation of the fluid path within the neck member, means for driving the first disc of the disc assembly, whereby the pump assembly serves the dual function of mixing and recirculating, and means for injecting a liquid fertilizer under pressure to merge with the tangential discharge of the pump, thereby creating a turbulence to substantially relieve the "bumping" action caused by expansion of the pressurized liquid fertilizer upon contact with the liquid in the tank.

12. The combination of claim 11, wherein the means for driving the top disc comprises a vertical tube secured to the top wall of the pump housing and extending thereabove substantially coaxially of the mixing tank, a drive shaft journaled in bearings in the tube, means for connecting the lower end of the shaft to the top disc, and means externally of the tank for driving the top end of the drive shaft.

13. The combination of claim 12, further including a seal housing secured between the tube and the top wall of the pump housing, the seal housing having a cavity therein, and means for introducing a lubricant under pressure into the cavity.

14. In a high speed fluid blender for liquid fertilizer, a mixing and recirculating pump comprising, in combination, an annular housing having parallel side walls and further having a tangential discharge opening, means for injecting a liquid fertilizer under pressure to merge with the tangential discharge of the pump, thereby creating a turbulence to substantially relieve the "bumping" action caused by expansion of the pressurized liquid fertilizer upon contact with the liquid in the tank, one of the side walls having an inlet opening formed therein, an assembly of a plurality of circular planar blades rotatably mounted in the housing, the blades having a substantial axial clearance with respect to the parallel side walls, the blades being substantially alined coaxially with one another, the blades having a substantial radial clearance with respect to the annular housing, the radial clearance increasing in the direction of rotation towards the tangential discharge opening, a plurality of circumferentially-spaced fastening means for connecting the blades together near the respective circumferences thereof, a generally funnel-shaped completely hollow inlet neck carried by a side wall and in communication with the inlet opening therein, and at least the planar blades adjacent to the side wall having a central opening therein directly in communication with the completely hollow inlet neck.

15. In a high-speed fluid blender for the fertilizer industry, a mixing and recirculating pump disposed externally of the blender and comprising, in combination, an annular pump housing having a tangential discharge opening, at least one blade rotatably mounted in the housing, the blade having a substantial radial clearance with respect to the annular housing, the radial clearance increasing in the direction of rotation towards the tangential discharge opening, and means externally of the pump for injecting a liquid fertilizer ingredient under pressure to merge with the tangential discharge of the pump, said last-named means including a pipe mounted substantially tangentially of the pump housing directly at the discharge opening therein, whereby the injected liquid fertilizer merges directly with the tangential discharge of the pump, thereby creating a turbulence to form a shock-absorbing foam to substantially relieve the "bumping" action caused by expansion of the liquid fertilizer ingredient upon contact with the liquids.

16. The high-speed fluid blender of claim 15, wherein the liquid fertilizer ingredient comprises pressurized anhydrous ammonia.

17. In combination, a mixing tank for liquid chemical fertilizers including at least one granular ingredient, the mixing tank having a truncated funnel-shaped bottom portion, a pump assembly serving the dual function of both mixing and recirculating the liquid contents of the tank, the pump assembly including a pump housing having parallel side walls and an annular wall between the side walls, the annular wall having a tangential discharge opening formed therein, conduit means connecting the discharge opening with the mixing tank, means for injecting a liquid fertilizer under pressure to merge with the tangential discharge of the pump, thereby creating a turbulence to substantially relieve the "bumping" action caused by expansion of the pressurized liquid fertilizer upon contact with the liquid in the tank, an assembly of a plurality of substantially planar parallel circular blades mounted within the pump housing, a plurality of circumferentially-spaced means for connecting the blades together near the respective circumferences thereof, means including a central drive shaft extending through one of the side walls of the pump housing and connected to the nearest blade for driving the plurality of blades in unison, at least some of the remaining blades having a central circular opening formed therein, the respective circumferences of the blades having a substantial radial clearance with respect to the annular wall of the pump housing, the radial clearance increasing in the direction of rotation of the blade assembly towards the tangential discharge opening, thereby forming a volute chamber for increasing the velocity of fluid flow towards the discharge opening, the blade assembly having a substantial axial clearance with respect to the parallel side walls of the pump housing, the other side wall having an inlet opening formed therein, at least the planar blade adjacent to the other side wall having a central opening formed therein in substantial alinement with the inlet opening in the planar blade, and a completely hollow inlet neck carried by the other side wall and in communication with the inlet opening therein, whereby the pump assembly serves the dual function of mixing and recirculating, and whereby the granular ingredient will not clog the pump assembly.

18. The method of blending liquid fertilizer, comprising the steps of providing a mixing tank serving as a reaction vessel, introducing a predetermined amount of water, a phosphate fertilizer, pressurized anhydrous ammonia to react with the phosphate fertilizer, and a jelling clay into the tank, providing a disc pump assembly having a plurality of spaced-apart substantially planar blades and further having a tangential discharge opening, mounting the disc pump assembly in a lower portion of the mixing tank, driving the disc pump to serve a combination mixing and recirculating function, thereby obviating the necessity for a separate recirculating pump and facilitating an improved liquid fertilizer product, and injecting the pressurized anhydrous ammonia to merge with the tangential discharge of the pump, thereby creating a turbulence to substantially relieve the "bumping" action caused by expansion of the pressurized anhydrous ammonia upon contact with the liquid in the tank.

19. The method of claim 18, wherein the phosphate fertilizer comprises mono-ammonium phosphate.

* * * * *